US010587068B1

(12) United States Patent
Muja et al.

(10) Patent No.: US 10,587,068 B1
(45) Date of Patent: Mar. 10, 2020

(54) TOOL-LESS ENVIRONMENTAL CONNECTOR SEALING PLUG

(71) Applicants: Oliviu Muja, Leonardtown, MD (US); Raymond-Ramil Tercedo Tuazon, Hollywood, MD (US)

(72) Inventors: Oliviu Muja, Leonardtown, MD (US); Raymond-Ramil Tercedo Tuazon, Hollywood, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 16/141,265

(22) Filed: Sep. 25, 2018

(51) Int. Cl.
*H01R 13/443* (2006.01)

(52) U.S. Cl.
CPC ..... *H01R 13/443* (2013.01)

(58) Field of Classification Search
CPC ..... H01R 13/443
USPC ..... 439/148
See application file for complete search history.

(56) References Cited

U.S. PATENT DOCUMENTS 2,228,641 A * 1/1941 Roser ..... H01R 13/447 439/148
4,993,964 A * 2/1991 Trummer ..... H01R 13/443 439/272
5,226,832 A * 7/1993 Dejardin ..... H01R 13/5213 439/274
5,257,949 A * 11/1993 Paulus ..... H01R 13/7197 333/185
5,931,699 A * 8/1999 Saito ..... H01R 13/5208 439/275
7,156,697 B2 * 1/2007 Drescher ..... H01R 13/5205 439/587
7,559,797 B2 * 7/2009 Shishikura ..... H01R 13/443 439/148
7,798,829 B2 * 9/2010 Fong ..... H01R 13/443 439/148

(Continued)

OTHER PUBLICATIONS

MIL-DTL-38999M, Connectors, Electrical, Circular, Miniature, High Density, Quick Disconnect (Bayonet, Threaded or Breech Coupling), Environment Resistant With Crimp Removable Contacts or Hermetically Sealed With Fixed, Solderable Contacts, General Specification for, Feb. 11, 2015.

(Continued)

*Primary Examiner* — Travis S Chambers
(74) *Attorney, Agent, or Firm* — Mark O. Glut; NAWCAD

(57) ABSTRACT

A connector sealing plug for sealing openings on a connector. The plug includes a rod with a first end and a second end, with the first end having a first diameter, and the second end having a second diameter. The rod has a first bevel at the first end and a second bevel between the first end and the second end. The second diameter is larger than the first diameter, and the rod is adaptable to tool-lessly press fit into and out of the sealing openings such that a fluid resistant seal is formed and contacts within the connector are protected, wherein the sealing plug does not engage existing mechanical locks within the connector. The first end has a first fossa and the second end has a second fossa. The rod has a defined configuration identifiable by size, color, and fossae, and the rod is manufactured from electrically insulating material.

2 Claims, 4 Drawing Sheets

(56) References Cited

U.S. PATENT DOCUMENTS

| | | | | |
|---|---|---|---|---|
| 8,251,748 | B2 * | 8/2012 | Tyler | H01R 13/648 439/607.52 |
| 8,662,921 | B2 * | 3/2014 | Kataoka | H01R 13/443 439/148 |
| 9,960,523 | B2 * | 5/2018 | Kobayashi | H01R 13/521 |
| 2009/0258522 | A1 * | 10/2009 | Bracci | H01R 13/5205 439/279 |

OTHER PUBLICATIONS

MIL-C-85049/80, Connector Accessories, Electrical, Dummy Contact, Sizes 12 and 8, Catagory 7, Sep. 22, 1989.
MIL-C-85049/81, Connector Accessories, Electrical, Seal Plug, Sizes 10, Catagory 7, Sep. 22, 1989.
MIL-C-81969/14C, Installing and Removal Tools, Connector Electrical Contact, Type III, Class 2, Composition 8, Feb. 10, 1987.
MIL-C-39029D, Contacts, Electrical Connector, General Specification for, May 2, 1988.
MIL-I-81969B, Installing and Removal Tools, Connector Electrical Contact, General Specification for, Aug. 20, 1982.
MS27488N, Plug, End Seal, Electrical Connector, Jul. 22, 2008.

* cited by examiner

TOOL-LESS ENVIRONMENTAL CONNECTOR SEALING PLUG

STATEMENT OF GOVERNMENT INTEREST

The invention described herein may be manufactured and used by or for the Government of the United States of America for governmental purposes without payment of any royalties thereon or therefor.

BACKGROUND

The United States Navy requires that every unused electrical cavity in an environmentally rated connector be plugged and sealed. Therefore, if only two contacts of a twenty-four contact plug are being used, the remaining twenty-two cavities must be plugged and sealed. The currently used sealing method is not designed for effective maintenance or initial assembly. Depending on size and configuration, connectors may require the use of unwired contact and sealing plugs, or specialized sealing plugs to effectively seal the unused connector cavities. Some sealing plugs require specialized tooling in order to remove them or the unwired contacts. Often when removing these sealing plugs and/or contacts, the connector is broken or the plugs cannot be removed. This requires the replacement of the connector, which adds a significant amount of work time for the maintainer and delays for connector procurement. Not installing plugs or the unwired contacts may lead to performance degradation, and/or risk of electrical system damage, or loss of aircraft. As a result, there is a need for an effective electrical connector sealing plug which can be installed and removed without tools, while performing the connector sealing functions.

SUMARY

The present invention is directed to a connector sealing plug for sealing openings on a connector. The connector sealing plug includes a rod. The openings on the connector are a sealing grommet opening and an interfacial seal opening. The rod has a first end and a second end, with the first end having a first diameter, and the second end having a second diameter. The rod also has a first bevel disposed at the end of the first end and a second bevel disposed between the first end and the second end. The second diameter is larger than the first diameter, and the rod is adaptable to tool-lessly press fit into and out of the sealing grommet opening and the interfacial seal opening such that a fluid resistant seal is formed and contacts within the connector are protected, wherein the sealing plug does not engage existing mechanical locks within the connector. The first end has a first fossa for enabling use of a tool to remove the sealing plug from the connector openings, and the second end having a second fossa for enabling use of an optional tool to install the sealing plug into the connector openings. The rod has a defined configuration identifiable by size, color, and fossae, and the rod is manufactured from electrically insulating material.

It is a feature of the present invention to provide a sealing plug that is tool-less and is easy to install and remove from a corresponding connector.

It is a feature of the present invention to provide a sealing plug that meets and exceeds performance of legacy sealing plugs used on U.S. Navy platforms.

It is a feature of the present invention to provide a way to incorporate all these features onto standard environmental rated connectors. One typical application is the Mil-Dtl-38999, Connectors, Electrical, circular, miniature, High Density, Quick Disconnect (Bayonet, Threaded or Breach Coupling), Environment Resistant with Crimp Removable Contacts or Hermetically Sealed with Fixed, Solderable Contacts, General Specification For. This specification is hereby incorporated by reference.

It is a feature of the present invention to provide a sealing plug that provides a means of identifying the configuration of the sealing plug by visual inspection.

DRAWINGS

These and other features, aspects, and advantages of the present invention will become better understood with reference to the following description and appended claims, and accompanying drawings wherein:

DESCRIPTION

Figure 1:
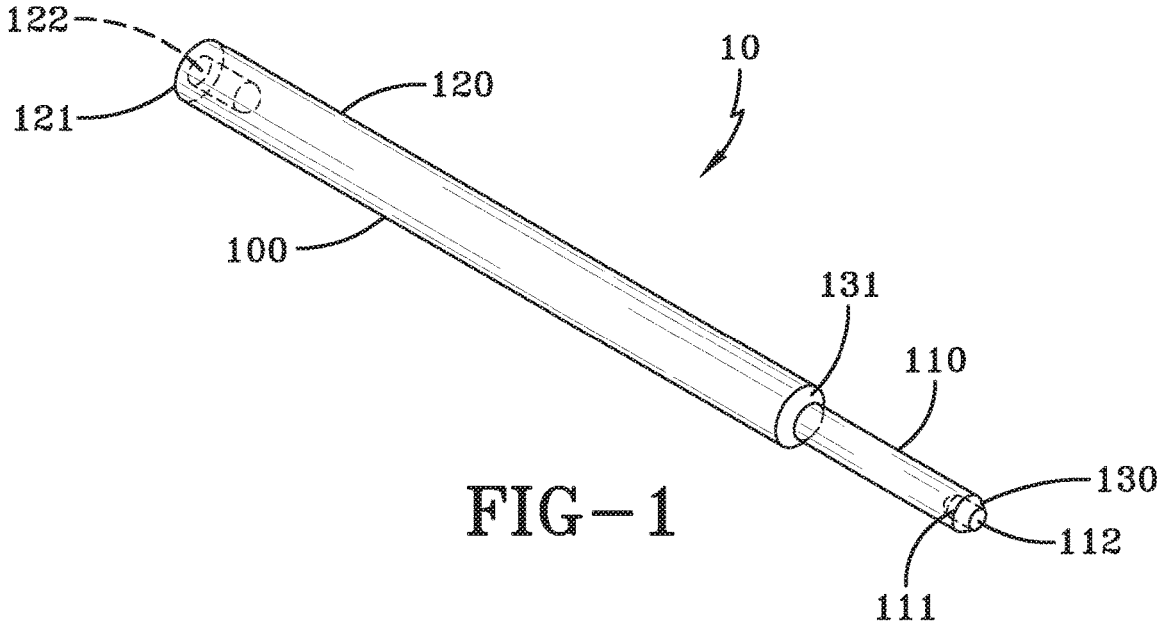
FIG. 1 is a perspective view of an exemplary embodiment of a sealing plug.
Figure 2A:
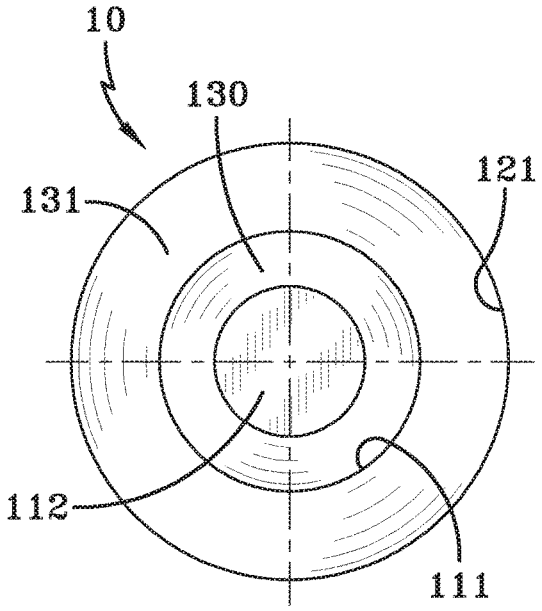
FIG. 2A is a front view of an exemplary embodiment of a sealing plug.
Figure 2B:
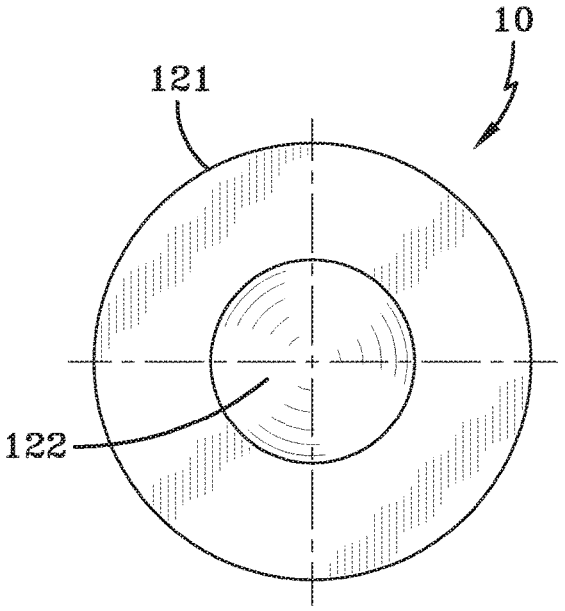
FIG. 2B is a back view of an exemplary embodiment of a sealing plug.
Figure 3A:
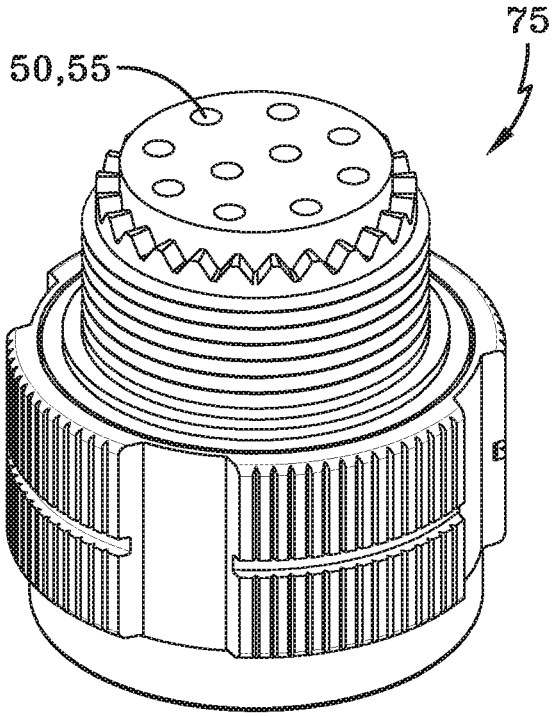
FIG. 3A is a perspective view of an exemplary embodiment of a connector.
Figure 3B:
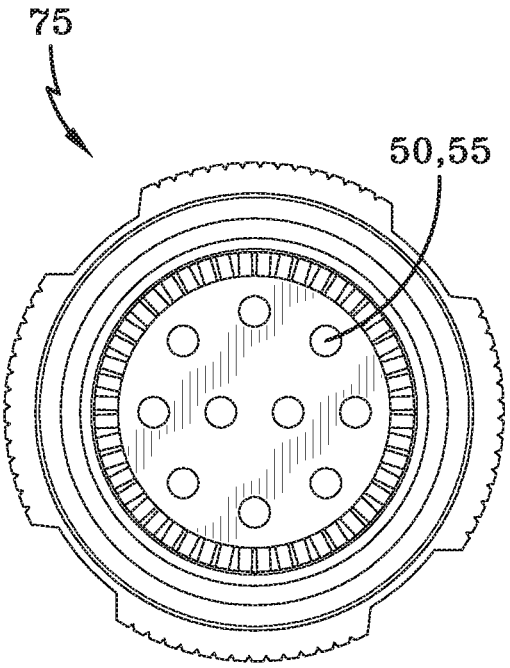
FIG. 3B is a top view of an exemplary embodiment of a connector.
Figure 3C:
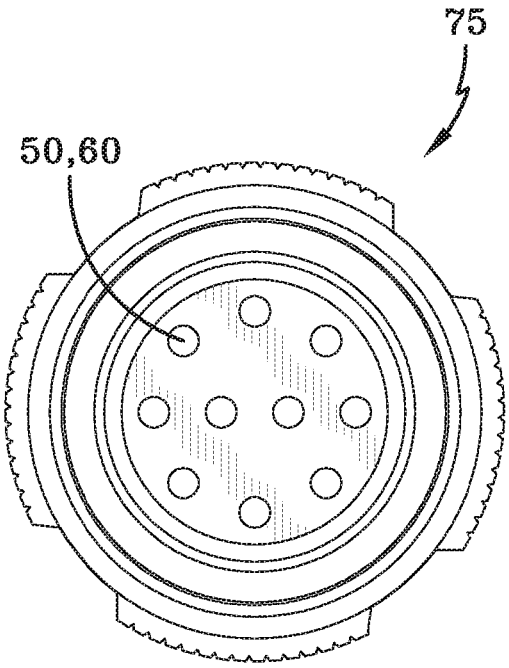
FIG. 3C is a bottom view of an exemplary embodiment of a connector.

The preferred embodiments of the present invention are illustrated by way of example below and in FIGS. 1-5. As shown in FIG. 1, the sealing plug 10 for sealing openings 50 on a connector 75 includes a rod 100. The openings 50 on the connector 75 are a sealing grommet opening 55 and an interfacial seal opening 60. The rod 100 has a first end 110 and a second end 120, with the first end 110 having a first diameter 111, and the second end 120 having a second diameter 121. The rod 100 also has a first bevel 130 disposed at the end of the first end 110 and a second bevel 131 disposed between the first end 110 and the second end 120. The second diameter 121 is larger than the first diameter 111, and the rod 100 is adaptable to tool-lessly press fit into and out of the sealing grommet opening 55 and the interfacial seal opening 60 such that a fluid resistant seal is formed and contacts 80 within the connector 75 are protected, wherein the sealing plug 10 does not lock into, existing mechanical locks 76 within the connector 75. The first end 110 has a first fossa 112 for enabling use of a tool to remove the sealing plug 10 from the connector openings 50, and the second end 120 having a second fossa 122 for enabling use of a tool to install the sealing plug 10 into the connector openings 50. The rod 100 has a defined configuration identifiable by size, color, and fossae, and the rod 100 is manufactured from electrically insulating material.

In the description of the present invention, the invention will be discussed in a military aircraft environment; however, this invention can be utilized for any type of application that requires use of a sealing plug.

Figure 4:
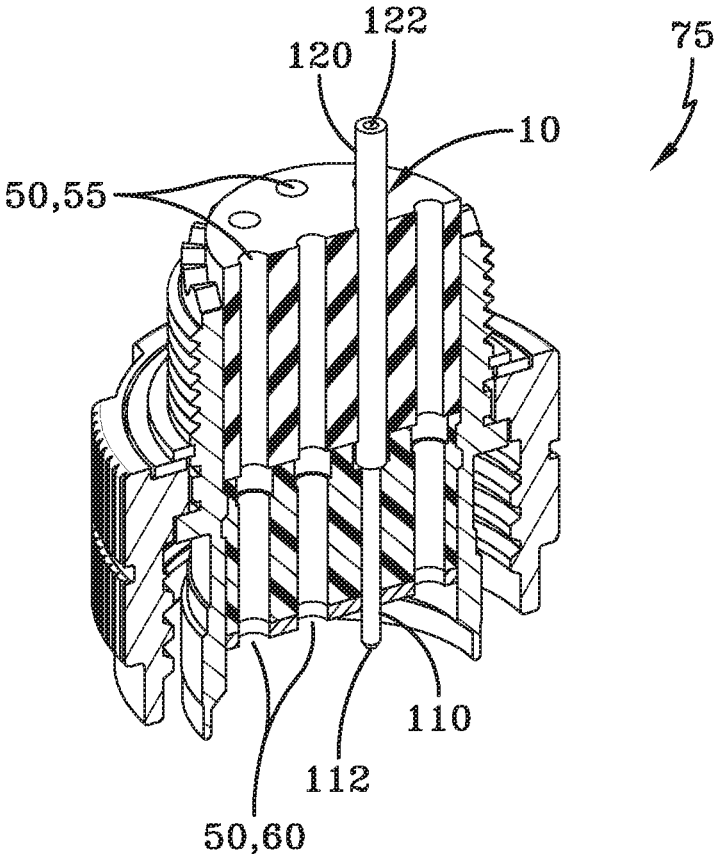
FIG. 4 is a cross sectional perspective view of an exemplary embodiment of a sealing plug in use with a connector.
Figure 5:
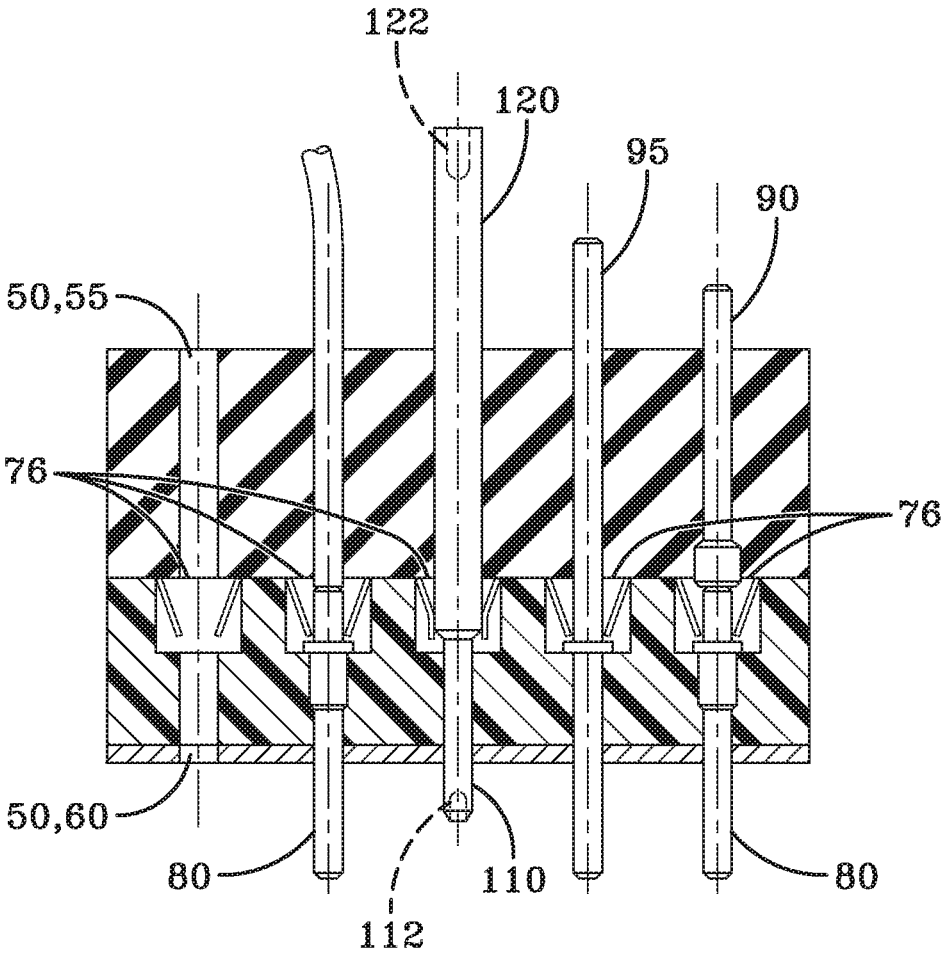
FIG. 5 is a cross sectional view of an exemplary embodiment of various sealing plug configurations in a connector. From left to right, we have (1) an open cavity, (2) a wired M39029 contact, (3) the present invention, (4) a currently employed M85049/80 or /81 specialty sealing plug, and (5) a currently employed MS27488 sealing plug with an unwired M39029 contact.

As shown in FIGS. 4 and 5, the rear of the connector 75 is where the sealing plug 10 is inserted and extracted through the sealing grommet opening 55, which is designed to protect the adjacent contacts 80 and internal area of connector 75 from fluid and debris contamination and damage. It also insulates the contacts electrically, ensuring a sound electrical connection between the plug 10 and receptacle. Shown from the front or mating end of the connector 75, the sealing plug 10 extends through the interfacial seal opening 60. In doing so, the sealing plug 10 seals both ends of the connector contact cavity. The sealing plug 10 design is a compression fit and seal for standard connectors such as defined in a typical Mil-Dtl-38999 connector specification. Furthermore, the length of the protruding sealing plug is designed and limited to not extend beyond the limits of the backshells with a 90 degree turn. Thus the design accommodates the shortest configuration accessories qualified and tested with that connector size and configuration. The length and diameter of the first end 110 of the rod 100 is designed to extend through the connector's internal contact locks and not engage. This ensures that the sealing plug 10 is held in place by friction of the sealing grommet 55 and the interfacial seal opening 60, thus no need for special extraction tool, and no need for the contact to be inserted in the connector for sealing. Both ends of the rod 100 incorporate a fossa 112, 122. These fossae 112, 122 or depressions enable identification of the configuration, and a different color may identify the size, as it aligns with the same color code used for the M81969 contact extraction tool tips defined in the Installing and Removing Tools Standard, Connector Electrical Contact, Type III, Class 2, Composition B Mil-I-81969/14 (incorporated by reference). M39029 contacts refer to contacts referenced by the Mil-C-39029 specification (incorporated by reference). MS27488 sealing plugs refer to sealing plugs referenced by the Naval Air Systems Command MS27488 detail specification sheet (incorporated by reference). M85049/80 and /81 sealing plugs refer to sealing plugs referenced by Mil-C-85049/80 and Mil-C-85049/81 detail specification sheets, respectively (incorporated by reference). M81969 tools refer to contact extraction tools referenced by the Mil-C-81969 specification (incorporated by reference).

Currently, unwired M39029 contacts with MS27488 sealing plugs require the use of special tools for extraction. For instance, FIG. 5 is a cross-section view of an environmental rated connector receptacle which employs the current design MS27488 sealing plugs 90 (plug shown in FIG. 5 furthest right). These MS27488 sealing plugs 90 are installed, large end first, after the M39029 unwired contact 80 is inserted in the connector 75. The M39029 unwired contact 80 locks in place and is only removed using special M81969 tools and tips for its extraction. The M81969 tips have a poor reliability and are prone to failure after limited use. FIG. 5 also shows a cross-section, close-up view of an environmental rated connector which employs another design using M85049/80 or /81 type sealing plugs 95 (second plug from right). These sealing plugs are installed without the need for an unwired contact inserted in the connector. This type of sealing plug locks in place and is only removable using special M81969 extraction tools, based on size and configuration of the contact and connector. The current sealing plug 10 does not require any special tools for extraction and/or insertion.

When introducing elements of the present invention or the preferred embodiment(s) thereof, the articles "a," "an," "the," and "said" are intended to mean there are one or more of the elements. The terms "comprising," "including," and "having" are intended to be inclusive and mean that there may be additional elements other than the listed elements.

Although the present invention has been described in considerable detail with reference to certain preferred embodiments thereof, other embodiments are possible. Therefore, the spirit and scope of the appended claims should not be limited to the description of the preferred embodiment(s) contained herein.

What is claimed is:

1. A sealing plug for sealing openings on a connector, the openings being a sealing grommet opening and an interfacial seal opening, which are disposed on opposite ends of a connector cavity that runs axially through the connector, the sealing plug comprising:

a rod having a first end and a second end, the first end having a first diameter, and the second end having a second diameter, and a bevel disposed between the first end and the second end, the second diameter being larger than the first diameter, the rod adaptable to tool-lessly press fit into and out of the sealing grommet opening and the interfacial seal opening such that a fluid resistant seal is formed and contacts within the connector are protected and that the sealing grommet opening and the interfacial seal openings are filled such that both ends of the connector cavity are sealed, wherein the sealing plug does not lock into existing mechanical locks within the connector, the first end having a first fossa for enabling use of a tool to remove the sealing plug from the connector openings, and the second end having a second fossa for enabling use of a tool to install the sealing plug into the connector openings, the rod having a defined configuration identifiable by size, color, and fossae, and the rod being manufactured from electrically insulating material.

2. The sealing plug of claim 1, wherein the bevel is sized such that it enables the rod to fit in various configuration connectors.

* * * * *